US008949018B2

(12) United States Patent
Kaminade

(10) Patent No.: US 8,949,018 B2
(45) Date of Patent: Feb. 3, 2015

(54) DRIVING ASSISTANCE DEVICE AND DRIVING ASSISTANCE METHOD

(75) Inventor: Takuya Kaminade, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/125,816

(22) PCT Filed: Jun. 13, 2011

(86) PCT No.: PCT/JP2011/063531
§ 371 (c)(1),
(2), (4) Date: Dec. 12, 2013

(87) PCT Pub. No.: WO2012/172632
PCT Pub. Date: Dec. 20, 2012

(65) Prior Publication Data
US 2014/0142839 A1 May 22, 2014

(51) Int. Cl.
*G08G 1/16* (2006.01)

(52) U.S. Cl.
CPC ..... *G08G 1/166* (2013.01); *G08G 1/163* (2013.01); *G08G 1/165* (2013.01)
USPC ..... 701/301

(58) Field of Classification Search
CPC ..... G01S 13/93; G01S 13/931; G01S 15/931; G01S 17/936; G08G 1/16; G08G 1/165; G08G 1/166; G08G 5/06
USPC ..... 701/300, 301
See application file for complete search history.

(56) References Cited

U.S. PATENT DOCUMENTS

| | | | | |
|---|---|---|---|---|
| 7,295,925 | B2 * | 11/2007 | Breed et al. | 701/301 |
| 2004/0193374 | A1 * | 9/2004 | Hac et al. | 701/301 |
| 2005/0033517 | A1 | 2/2005 | Kondoh et al. | |
| 2007/0021876 | A1 | 1/2007 | Isaji et al. | |
| 2007/0030131 | A1 | 2/2007 | Takahama et al. | |
| 2007/0032914 | A1 * | 2/2007 | Kondoh et al. | 701/1 |
| 2008/0097699 | A1 * | 4/2008 | Ono | 701/300 |
| 2010/0030426 | A1 * | 2/2010 | Okita | 701/41 |
| 2010/0222958 | A1 | 9/2010 | Kobayashi et al. | |
| 2013/0293395 | A1 | 11/2013 | Ohama et al. | |

FOREIGN PATENT DOCUMENTS

| | | | |
|---|---|---|---|
| JP | 2005-63021 | A | 3/2005 |
| JP | 2007-41788 | A1 | 2/2007 |
| JP | 2007-76632 | A | 3/2007 |
| JP | 2009-026321 | A | 2/2009 |
| JP | 2009-208505 | A | 9/2009 |
| JP | 2010-221995 | A | 10/2010 |
| JP | 2012-118741 | A | 6/2012 |
| WO | WO 03005325 | A1 * | 1/2003 |
| WO | 2006/070865 | A1 | 7/2006 |

* cited by examiner

*Primary Examiner* — Mary Cheung
*Assistant Examiner* — Rodney Butler
(74) *Attorney, Agent, or Firm* — Sughrue Mion, PLLC

(57) ABSTRACT

The necessity of the emergency avoidance assistance is determined. In a case where the emergency avoidance assistance is determined to be necessary, emergency avoidance assistance is implemented, and in a case where the emergency avoidance assistance is determined not to be necessary, the prediction assistance is implemented. According to this configuration, it is possible to perform the assistance according to emergency level of the collision. When it is the time of emergency state, it is possible to avoid (decrease) the collision without delaying the assistance, and when it is not the time of emergency state, it is possible to avoid the future collision in advance by the highly accurate prediction.

9 Claims, 11 Drawing Sheets

DRIVING ASSISTANCE DEVICE AND DRIVING ASSISTANCE METHOD

CROSS REFERENCE TO RELATED APPLICATIONS

This application is a National Stage of International Application No. PCT/JP2011/063531, filed on Jun. 13, 2011, the contents of all of which are incorporated herein by reference in their entirety.

TECHNICAL FIELD

The present invention relates to a driving assistance device and a driving assistance method that can implement emergency avoidance assistance which is performed in a case where the current state is in a timing of a collision, and can implement prediction assistance which is performed by predicting a possibility of a future collision, for avoiding a collision between a host vehicle and an obstacle.

BACKGROUND ART

A variety of technologies have been developed which assist the driver of a vehicle. For example, there is driving assistance for avoiding a collision between a host vehicle and an obstacle (another vehicle, a walker, and the like). In driving assistance for avoiding a collision, for example, there are emergency avoidance assistance (Pre Crash Safety (PCS) or the like) and prediction assistance. Emergency avoidance assistance is assistance for avoiding collision in the timing when the obstacle exists closely in front of the host vehicle, a collision is apparent from a current relative position and a relative speed of the host vehicle and the obstacle, and there is no time to spare before the collision. In addition, even when there is no possibility of collision at the present time, if any change of the host vehicle and the obstacle (for example, a walker walking on the roadside jumps out into the roadway) is considered, there is a case where the possibility of a future collision arises. Here, prediction assistance is assistance for avoiding a future collision (a collision that is farther in time and distance than imminent collision subject to emergency avoidance assistance) in advance by predicting the possibility of a future collision between the host vehicle and an obstacle in consideration of various future situations of the host vehicle and the obstacle when there is time to spare before the collision. In Patent Literature 1, a technology is disclosed in which a risk potential of an obstacle around a host vehicle is calculated and driving operation is assisted based on the risk potential.

CITATION LIST

Patent Literature

[Patent Literature 1] Japanese Unexamined Patent Application Publication No. 2010-221995

SUMMARY OF INVENTION

Technical Problem

In a case where prediction assistance is performed, considering various situations, it is necessary to perform a complicated calculation for collision prediction. For example, the calculation for searching for factors which enables the prediction of the possibility of a walker's jumping out based on information about the environment around a host vehicle and for respectively determining the possibility of the collision with respect to the predictable jumping out is needed. For this reason, the calculation cost for prediction assistance is very high compared to emergency avoidance assistance, and it is necessary to secure sufficient time to perform the calculation for the collision prediction with high accuracy. Therefore, in case of an emergency state where collision is apparent when the prediction assistance is performed, there is a concern that the assistance may be delayed.

Here, an object of the present invention is to provide a driving assistance device and a driving assistance method that performs an appropriate assistance, in a case where both emergency avoidance assistance and prediction assistance can be implemented, according to the situation.

Solution to Problem

A driving assistance device of the present invention can implement emergency avoidance assistance which is performed in a case where the current state is in a timing of the collision, and prediction assistance which is performed by predicting a possibility of a future collision, for avoiding a collision between a host vehicle and an obstacle. The driving assistance device includes necessity determination means for determining the necessity of emergency avoidance assistance, and implementation means for implementing the emergency avoidance assistance in a case where the necessity determination means determines that the emergency avoidance assistance is necessary, and implementing the prediction assistance in a case where the necessity determination means determines that emergency avoidance assistance is not necessary.

The driving assistance device can implement both emergency avoidance assistance and prediction assistance, and performs assistance by selecting any of emergency avoidance assistance and prediction assistance for avoiding the collision between the host vehicle and the obstacle (for example, moving objects such as a walker, a bicycle, a motor cycle, and a vehicle, and motionless objects such things that have fallen into the road and the like). The emergency avoidance assistance is assistance for avoiding the collision in the emergency state which is timing when the collision between the host vehicle and the obstacle is apparent from the current situation of the host vehicle and the obstacle. In this case, the calculation cost is low because the determination is made by only the current situation. The prediction assistance is assistance for avoiding the future collision in advance by predicting the future situation of the host vehicle and the obstacle and predicting the possibility of future collision from the predicted situation. In this case, the calculation cost is high because it is necessary to predict the various future situations.

Particularly, in the driving assistance device, the necessity determination means determines the necessity of the emergency avoidance assistance from the current situation. Then, in the driving assistance device, the implementation means implements the emergency avoidance assistance in a case where the emergency avoidance assistance is necessary, and implements the prediction assistance in a case where the emergency avoidance assistance is not necessary. In this way, in the driving assistance device, since any of the emergency avoidance assistance and the prediction assistance is implemented with the determination of the necessity of the emergency avoidance assistance, it is possible to perform the assistance according to the emergency level of the collision. When it is the time of emergency state, the emergency avoidance assistance can immediately be implemented, and it is possible to avoid (decrease) the collision without delaying the assistance. On the other hand, when it is not the time of emergency state, the prediction assistance with high accuracy can be implemented with securing a sufficient calculation time, and it is possible to avoid the future collision in advance.

The driving assistance device of the present invention may have a configuration to further include environment change detection means for detecting a change of environment around the host vehicle, and continuation determination means for determining whether or not the prediction assistance currently implemented will be continued based on the detection result of the environment change detection means in a case where the prediction assistance is implemented.

In the driving assistance device, the environment change detection means detects the change of the environment (for example, a moving object and a stationary object, a traffic signal, a traffic sign, a crosswalk, and the weather) around the host vehicle. For example, in a case where a new obstacle is detected as a change of the environment around the host vehicle, the possibility that the assistance currently implemented for avoiding the new obstacles has to be changed is high. On the other hand, in a case where a new obstacle is not detected, the assistance currently implemented can be continuously implemented. Therefore, in the driving assistance device, the continuation determination means determines whether the prediction assistance currently implemented will be continued or not based on the change of the environment of the host vehicle. In this way, in the driving assistance device, by the determination whether the prediction assistance currently implemented will be continued or not from the change of the environment of the host vehicle, prompt assistance with respect to the change of the environment can be implemented, and in a case where the environment is not changed, the prediction assistance currently implemented can continuously be implemented and the calculation cost can be reduced.

The driving assistance device of the present invention may have a configuration to further include host vehicle state change detection means for detecting the change of the host vehicle state, in which, in a case where the prediction assistance is implemented, the continuation determination means determines whether or not the prediction assistance currently implemented will be continued, based on the detection result of the host vehicle state change detection means.

In the driving assistance device, the host vehicle state change detection means detects the change of the host vehicle state (for example, the vehicle speed, acceleration, steering angle, steering operation, accelerator pedal operation, brake pedal operation, shift operation, and the driver's line of sight). In a case where the host vehicle state is changed, since the future state of the vehicle is changed, the possibility that the assistance currently implemented has to be changed is high. On the other hand, in a case where the host vehicle state is not changed, the assistance currently implemented can continuously be implemented. Therefore, in the driving assistance device, the continuation determination means determines whether the prediction assistance currently implemented will be continued or not based on the change of the host vehicle state. In this way, in the driving assistance device, by the determination whether or not the assistance currently implemented will be continued from the change of the host vehicle state, prompt assistance with respect to the change of the host vehicle state can be implemented, and in a case where the host vehicle state is not changed, the prediction assistance currently implemented can continuously be implemented and the calculation cost can be reduced.

In the driving assistance device of the present invention, in a case where the continuation determination means determines that the prediction assistance will not be continued, it is preferable that the implementation means implements an assistance more strengthened or more weakened than the assistance content currently implemented, based on the assistance content currently implemented.

In the driving assistance device, in a case where the prediction assistance is determined not to be continued, implementation means implements more weakened assistance than the assistance currently implemented (for example, decreased amount of assistance in braking and decreased amount of assistance in steering) or more strengthened assistance than the assistance currently implemented (for example, increased amount of assistance in braking and increased amount of assistance in steering) based on the assistance content currently implemented (for example, amount of assistance in braking and the amount of assistance in steering). In this way, in the driving assistance device, even in a case where the prediction assistance currently implemented will not be continued, the assistance content is only corrected based on the assistance content currently implemented, rather than determining the assistance content by starting again from the beginning. Therefore, it is possible to reduce the calculation cost and ensure safety with respect to the collision.

A driving assistance method of the present invention is a method that can implement emergency avoidance assistance which is performed in a case where the current state is in a timing of the collision, and prediction assistance which is performed by predicting a possibility of a future collision for avoiding a collision between a host vehicle and an obstacle. The driving assistance method includes a necessity determination step of determining the necessity of an emergency avoidance assistance, and an implementation step of implementing the emergency avoidance assistance in a case where the emergency avoidance assistance is determined to be necessary in the necessity determination step, and implementing the prediction assistance in a case where the emergency avoidance assistance is determined not to be necessary in the necessity determination step.

The driving assistance method of the present invention may further include an environment change detection step of detecting a change of environment around the host vehicle, and a continuation determination step of determining whether or not the prediction assistance currently implemented will be continued based on the detection result in the environment change detection step in a case where the prediction assistance is implemented.

The driving assistance method of the present invention may further include a host vehicle state change detection step of detecting the change of the host vehicle state. In the continuation determination step, in a case where the prediction assistance is implemented, whether or not the prediction assistance currently implemented will be continued is determined based on the detection result in the host vehicle state change detection step.

In the implementation step of the driving assistance method in the present invention, in a case where it is determined that the prediction assistance will not be continued in the continuation determination step, the assistance more strengthened or weakened than the assistance content currently implemented is implemented based on the assistance content currently implemented.

The driving assistance method acts in the same manner as the driving assistance device described above, and has the same effect.

Advantageous Effects of Invention

According to the present invention, since any of the emergency avoidance assistance and the prediction assistance is implemented with the determination of the necessity of the emergency avoidance assistance, it is possible to perform the assistance according to emergency level of the collision. When in the time of an emergency state, it is possible to avoid (decrease) the collision without delaying the assistance, and when it is not the time of emergency state, it is possible to avoid the future collision in advance by the highly accurate prediction.

DESCRIPTION OF EMBODIMENTS

Figure 1:
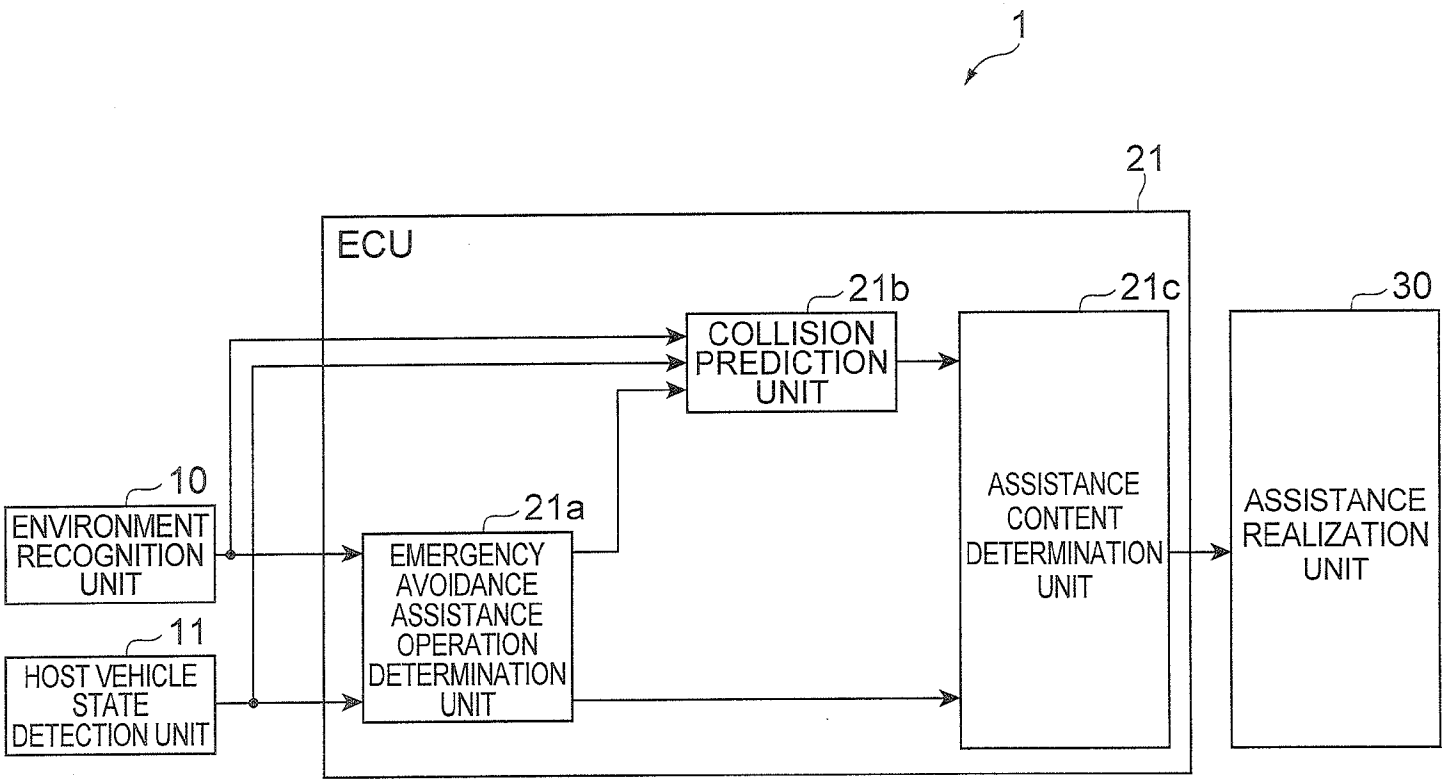
FIG. 1 is a configuration diagram of a driving assistance device in a first embodiment.

Hereinafter, an embodiment of a driving assistance device and a driving assistance method in the present invention will be described with reference to the drawings. In each drawing, the same reference numerals will be given to the same or equivalent elements, and descriptions thereof will not be duplicated.

In the embodiments, the present invention is applied to the driving assistance device which is mounted on a vehicle and performs assistance for avoiding a collision with an obstacle. The driving assistance device in the embodiments determines the possibility of the collision between the host vehicle and the obstacle, and performs driving assistance by a vehicle control (a brake control or a steering control) or by a Human Machine Interface (HMI) in a case where there is a possibility of collision at present or in the future. There are three embodiments in the present embodiments. In the first embodiment, both of emergency avoidance assistance and prediction assistance can be implemented. The first embodiment has a basic form of performing the driving assistance by selecting any of the emergency avoidance assistance and the prediction assistance. In the second embodiment, at least the prediction assistance can be implemented. The second embodiment includes a function of decreasing a calculation cost of the prediction assistance. The third embodiment has a form in which the function of decreasing a calculation cost of the prediction assistance in the second embodiment is combined to the basic form of the emergency avoidance assistance and the prediction assistance in the first embodiment.

The obstacle is an object which has a possibility of hindering the travel of the host vehicle. Examples of obstacles include moving object such as a walker, a bicycle, a motor cycle, and a vehicle and stationary objects such as an object falling on the road and the like. The emergency avoidance assistance (for example, PCS) is the assistance for avoiding the collision in the emergency situation in which the obstacle exists close to the host vehicle and the collision can occur from the current situation of the host vehicle and the obstacle, and is the assistance for avoiding the upcoming collision. The prediction assistance is the assistance for avoiding the future collision in advance by predicting the possibility of the future collision between the host vehicle and the obstacle in consideration of various future situations of the host vehicle and the obstacle, and is the assistance for avoiding the collision that is farther in time and distance than the upcoming collision subject to the emergency avoidance assistance.

Figure 2:
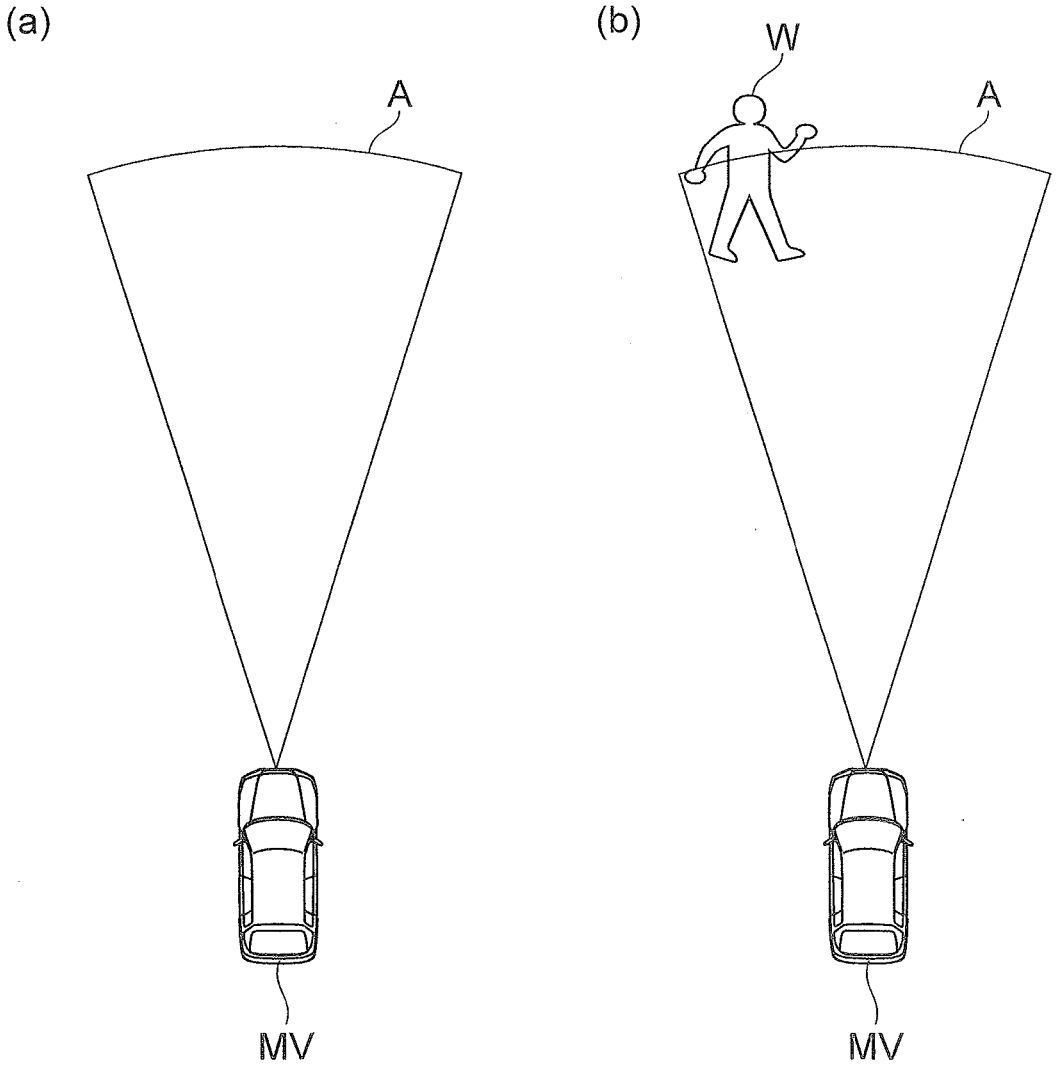
FIG. 2 is an example of cases where emergency avoidance assistance is necessary; (*a*) illustrates a recognition range and (*b*) illustrates a case of recognizing a walker in the recognition range.
Figure 3:
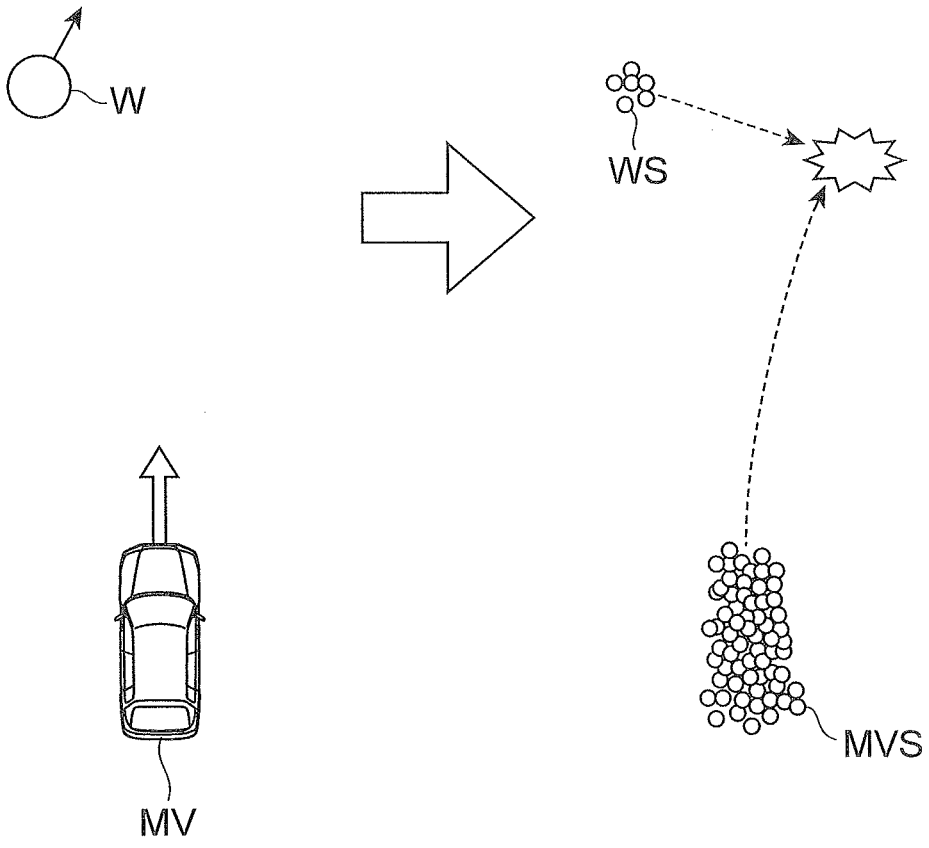
FIG. 3 is a diagram explaining prediction assistance.

The driving assistance device 1 in the first embodiment will be described with reference to FIG. 1 to FIG. 3. FIG. 1 is a configuration diagram of the driving assistance device in the first embodiment. FIG. 2 is an example of cases where emergency avoidance assistances are required; (*a*) illustrates a recognition range and (*b*) illustrates a case of recognizing a walker in the recognition range. FIG. 3 is a diagram explaining prediction assistance.

The driving assistance device 1 can implement the emergency avoidance assistance and the prediction assistance for avoiding the collision between the host vehicle and the obstacle, and implements the assistance by selecting any of the emergency avoidance assistance and the prediction assistance. Particularly, the driving assistance device 1 determines the emergency of the collision, and immediately implements the emergency avoidance assistance in a case where there is an emergency and implements the prediction assistance in a case where there is not an emergency.

The driving assistance device 1 includes an environment recognition unit 10, a host vehicle state detection unit 11, an Electronic Control Unit (ECU) 21 (an emergency avoidance assistance operation determination unit 21*a*, a collision prediction unit 21*b*, an assistance content determination unit 21*c*), and an assistance realization unit 30. In the first embodiment, the emergency avoidance assistance operation determination unit 21*a* corresponds to necessity determination means described in the Claims and the assistance content determination unit 21*c* and the assistance realization unit 30 are corresponding to implementation means described in the Claims.

The environment recognition unit 10 is means for recognizing the environment around the host vehicle. The environment around the host vehicle includes, for example, an object which is an obstacle in the vicinity of the host vehicle or an object which could potentially become an obstacle, a traffic signal, a traffic sign, a crosswalk, and the weather. The environment recognition unit 10 includes, for example, a camera which takes pictures around the host vehicle (particularly, front side) and an image processing device, an external sensor which detects from the host vehicle such as a laser radar and a radar signal processing device, and a vehicle-to-vehicle communication device which collects information from another vehicle. The environment recognition unit 10 recognizes the environment around the host vehicle for each predetermined time interval and transmits the recognized information to the ECU 21. The example of the recognized information includes, in the case of an obstacle, the presence or absence of the obstacle (including an object which has a possibility of being an obstacle), and includes, in a case where the obstacle exists, a type, the position, the speed, the acceleration, and a traveling direction. Regarding the position, the relative position with respect to the host vehicle is preferable, and the absolute position may also be useful.

The host vehicle state detection unit 11 is means for detecting the state of the host vehicle. The example of the state of the host vehicle includes the position, the vehicle speed, the acceleration, the traveling direction, and includes also the driver's line of sight and the like in a case where the driver state is included in the host vehicle state. The example of the host vehicle state detection unit 11 includes a Global positioning System (GPS) receiver (or a navigation receiver), a vehicle speed sensor, a steering torque sensor, a steering angle sensor, an acceleration pedal sensor, a brake pedal sensor, a shift position sensor and a camera which takes a picture of the driver's face and the image processing device. The host vehicle state detection unit 11 detects the host vehicle state for each predetermined time interval and transmits the detected information to the ECU 21.

The ECU 21 is an electronic control unit which is formed of a Central Processing Unit (CPU), a Read Only Memory (ROM), and a Random Access Memory (RAM), and generally controls the driving assistance device 1. In the ECU 21, by an application program for the driving assistance device 1 stored in the ROM being loaded on the RAM and being executed in the CPU, the emergency avoidance assistance operation determination unit 21*a*, the collision prediction unit 21*b*, and the assistance content determination unit 21*c* are configured.

The emergency avoidance assistance operation determination unit 21*a* determines whether or not it is an emergency state that the collision occurs (or it is a timing when the future collision is apparent if the current state continues), based on the obstacle information of the obstacle recognizable by the environment recognition unit 10 and the host vehicle state detected by the host vehicle state detection unit 11. In a case where it is the emergency state, the emergency avoidance assistance operation determination unit 21*a* determines that the emergency avoidance assistance is necessary and in a case where it is not the emergency state, determines that the emergency avoidance assistance is not necessary (the prediction assistance is necessary based on the prediction of the collision).

An example of a determination method (in case of the PCS) in the emergency avoidance assistance operation determination unit 21*a* will be described with reference to FIG. 2. The emergency avoidance assistance operation determination unit 21*a* calculates a predicted travel route from the speed, the acceleration, a steering amount (traveling direction) detected by the host vehicle state detection unit 11. In addition, the environment recognition unit 10 performs the recognition of the recognition range A as illustrated in FIG. 2(*a*), and in a case where a walker W is recognized in the recognition range A as illustrated in FIG. 2(*b*), the emergency avoidance assistance operation determination unit 21*a* calculates a walker W's predicted moving route from the relative position, speed, acceleration, and traveling direction between the walker (obstacle) recognized by the environment recognition unit 10 and the host vehicle MV. Then, the emergency avoidance assistance operation determination unit 21*a* determines whether or not the predicted moving route of the obstacle intersects the predicted traveling route of the host vehicle. In a case where the routes do not intersect, the emergency avoidance assistance operation determination unit 21*a* determines that there is no emergency (in the current state, it is not the collision timing), and determines that the emergency avoidance assistance is not necessary. On the other hand, in a case where the routes intersect based on the current relative distance and the relative speed between the host vehicle and the obstacle, the emergency avoidance assistance operation determination unit 21*a* calculates a Time To Collision (TTC=relative distance/relative speed) which is a predicted collision time assuming the case that the current state continues, and determines whether or not the TTC is within the operation timing of the PCS. In a case where the TTC is longer than the operation timing of the PCS, the emergency avoidance assistance operation determination unit 21*a* determines that there is no emergency and determines that the emergency avoidance assistance is not necessary. On the other hand, in a case where the TTC is within the operation timing of the PCS, the emergency avoidance assistance operation determination unit 21*a* determines that there is the emergency and determines that the emergency avoidance assistance is necessary. The operation timing of the PCS is set by an experiment or simulation, and is a timing in which the degree of the collision decreases after the assistance or is timing (time from the current point in time) in which the collision can be avoided at the last moment.

In a case where the emergency avoidance assistance operation determination unit 21*a* determines that the emergency avoidance assistance is not necessary, the collision prediction unit 21*b* predicts the future moving range of the obstacle based on the obstacle information of the obstacle (an object which has a possibility of becoming an obstacle) recognizable by the environment recognition unit 10, and predicts the future traveling range of the host vehicle based on the host vehicle state detected by the host vehicle state detection unit 11, and predicts whether or not there is a possibility of a future collision based on the predicted moving range of the obstacle and the predicted traveling range of the host vehicle. Here, the prediction is performed in consideration of all the changes of state of the obstacle and the host vehicle. As the object which has a possibility of becoming an obstacle, the walker walking on the roadside can be considered to jump out to the driveway. Accordingly, such a walker is the object which has a possibility of becoming an obstacle.

An example of the prediction method in the collision prediction unit 21*b* will be described with reference to FIG. 3. The collision prediction unit 21*b* sets the position of the walker W (an object which has a possibility of becoming an obstacle) recognizable by the environment recognition unit 10 with respect to the host vehicle MV, as illustrated in FIG. 3. At that time, the position, the size, and the speed of the walker are set. Next, the collision prediction unit 21*b* expresses the host vehicle MV and the walker W as a cluster of grains (particles) MVS and WS distributed in a predetermined range respectively as illustrated in FIG. 3. The distribution range is determined by the position and the size of the particles. The number of the particles increases as the size of the particle is larger. Then, the collision prediction unit 21*b* calculates the future traveling range of the host vehicle and calculates the future moving range in a case where the walker jumps out, to calculate the timing and the degree of the collision based on the future traveling range of the host vehicle and the future moving range. At this time, the particles are strewed for each predetermined time interval and the distribution range of the particles spreads as the time passes (the possibility of the particles existence is scattered). The degree of the collision is determined according to the number of particles of the host vehicle and the number of particles of the walker that collide. Then, the collision prediction unit 21*b* expresses the degree of the risk of jumping out of the walker according to the degree of the collision. In a case where the degree of the risk is equal to or higher than the threshold value, the collision prediction unit 21*b* determines that the assistance is necessary in order to avoid the collision in advance.

The assistance content determination unit 21*c* determines the assistance content of the emergency avoidance assistance in a case where the emergency avoidance assistance operation determination unit 21*a* determines that the emergency avoidance assistance is necessary, and transmits the assistance content to the assistance realization unit 30. Here, the assistance content by which the collision can be avoided (or the degree of the collision can be decreased) is determined between the time before the predicted traveling route of the host vehicle and the predicted moving route of the obstacle intersect based on the calculation result by the emergency avoidance assistance operation determination unit 21*a*. As the assistance content, the means for assistance is determined from the braking assistance, the steering assistance, the HMI and the like, and the amount of the assistance is determined depending on the determined means. For example, in case of the braking assistance, the braking amount of the braking is determined for stopping the vehicle before the predicted traveling route of the host vehicle and the predicted moving route of the obstacle intersect, and in case of steering assistance, the steering direction and the steering amount of the steering in order for avoiding the intersecting point is determined.

In addition, the assistance content determination unit 21*c* determines the assistance content of the prediction assistance in a case where the collision prediction unit 21*b* determines that the prediction assistance is necessary, and transmits the assistance content to the assistance realization unit 30. Here, a range where the future traveling range of the host vehicle and the future moving range of the obstacle do not overlap is specified based on the prediction by the collision prediction unit 21*b*, and the assistance content is determined from the specified range and the movable range of the host vehicle. As the assistance content, the means for assistance is determined from the braking assistance, the steering assistance, the HMI assistance and the like, and the amount of the assistance is determined depending on the determined means. For example, in case of the braking assistance, the braking amount of the brake in order for inducing the vehicle to the place where the collision can be avoided in advance is determined, and in case of steering assistance, the steering direction and the steering amount of the steering in order to bring the vehicle to a place where the collision can be avoided in advance is determined, and in case of the HMI assistance, the types of the HMI (display, voice, alarm, and the like) is determined and the display content on the HMI (for example, the degree of the risk) and the voice content (for example, the instruction for the steering direction or the instruction for the brake operation) are determined.

The assistance realization unit 30 is means for realizing the assistance content determined by the ECU 21. For example, in case of the assistance by the vehicle control, as the assistance realization unit 30, there are the ECU for performing the brake control and the ECU for performing the steering control. In case of the assistance by the HMI, as the assistance realization unit 30, there are, for example, a display used in navigation device, a speaker, and a warning device. The assistance realization unit 30 realizes the assistance content for each assistance content received from the ECU 21.

Figure 4:
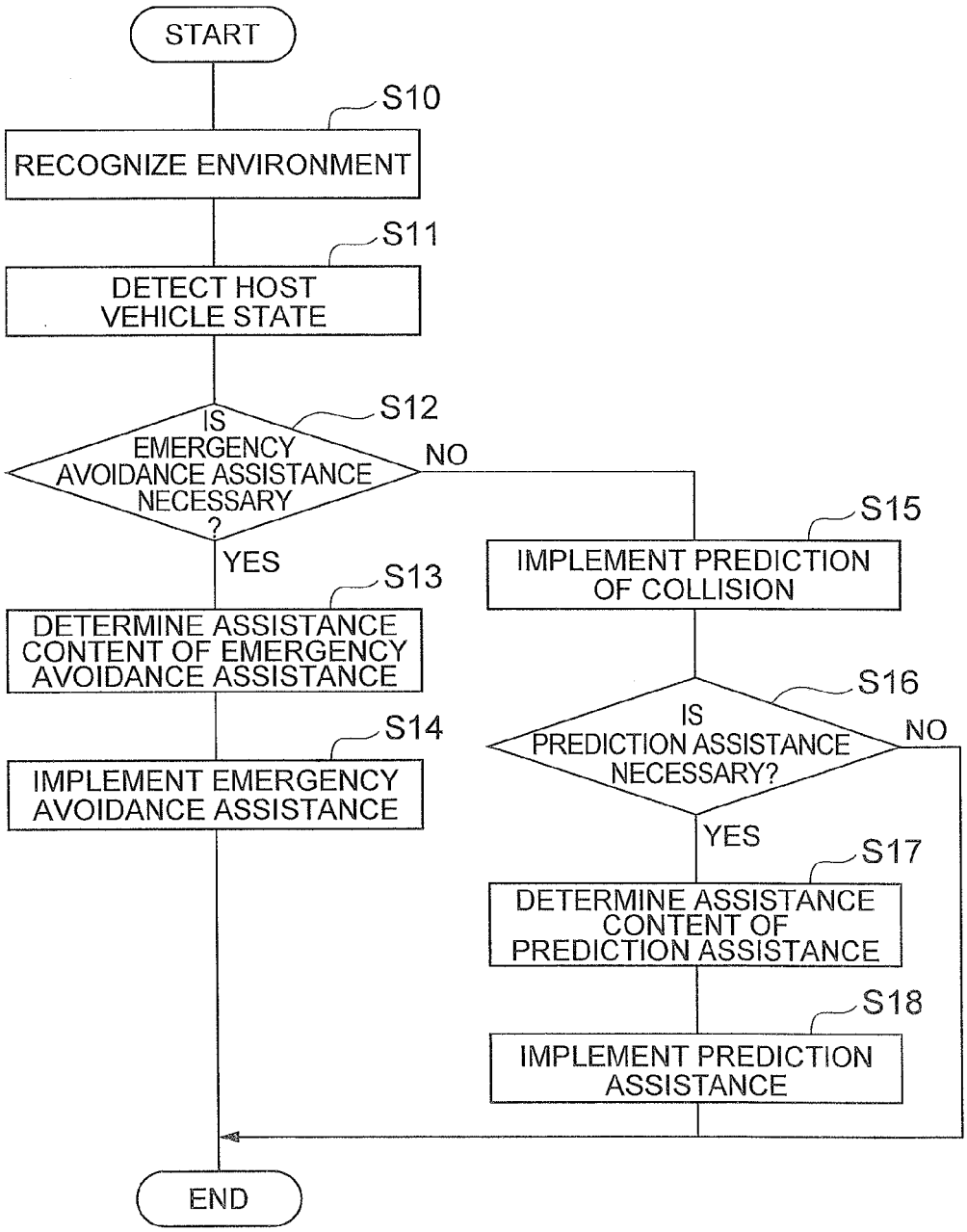
FIG. 4 is a flow chart illustrating an operation flow in the driving assistance device in the first embodiment.

With reference to FIG. 1, the operation in the driving assistance device 1 will be described along a flow chart in FIG. 4. FIG. 4 is a flow chart illustrating the operation flow in the driving assistance device in the first embodiment. In the driving assistance device 1, the operation described below is repeatedly performed for each predetermined time interval.

The environment recognition unit 10 recognizes the environment (particularly, the obstacle) around the host vehicle, and transmits the recognized information to the ECU 21 (S10). In addition, the host vehicle state detection unit 11 detects the host vehicle state and transmits the detected information to the ECU 21 (S11). Then, the ECU 21 determines whether or not the emergency avoidance assistance is necessary based on the recognized information about the environment around the host vehicle and the detected information about the host vehicle state (S12).

The ECU 21 determines, in a case where it is determined in S12 that the emergency avoidance assistance is necessary, the assistance content of the emergency avoidance assistance for avoiding the collision in the emergency state and transmits the assistance content to the assistance realization unit 30 (S13). The assistance realization unit 30 implements the emergency avoidance assistance based on the assistance content of the emergency avoidance assistance (S14).

The ECU 21 performs, in a case where it is determined in S12 that the emergency avoidance assistance is not necessary, the prediction of the collision based on the recognized information about the environment around the host vehicle and the detected information about the host vehicle state (S15) and determines whether or not the prediction assistance is necessary (S16). The ECU 21 determines, in a case where it is determined in S16 that the prediction assistance is necessary, the assistance content of the prediction assistance for avoiding the future collision in advance, and transmits the assistance content to the assistance realization unit 30 (S17). The assistance realization unit 30 implements the prediction assistance based on the assistance content of the prediction assistance (S18). In a case where it is determined in S16 that the prediction assistance is not necessary, the ECU 21 ends the current process without performing the assistance.

According to the driving assistance device 1, the need for the emergency avoidance assistance is determined and any of the emergency avoidance assistance and the prediction assistance is implemented based on the determination result. Accordingly, it is possible to perform the assistance according to the emergency level of the collision. When the emergency avoidance assistance is necessary, the emergency avoidance assistance can immediately be implemented, and it is possible to avoid (decrease) the collision without delaying the assistance. On the other hand, when the emergency avoidance assistance is not necessary, the prediction assistance with high accuracy can be implemented while ensuring a sufficient calculation time, and it is possible to avoid the future collision in advance.

Figure 5:
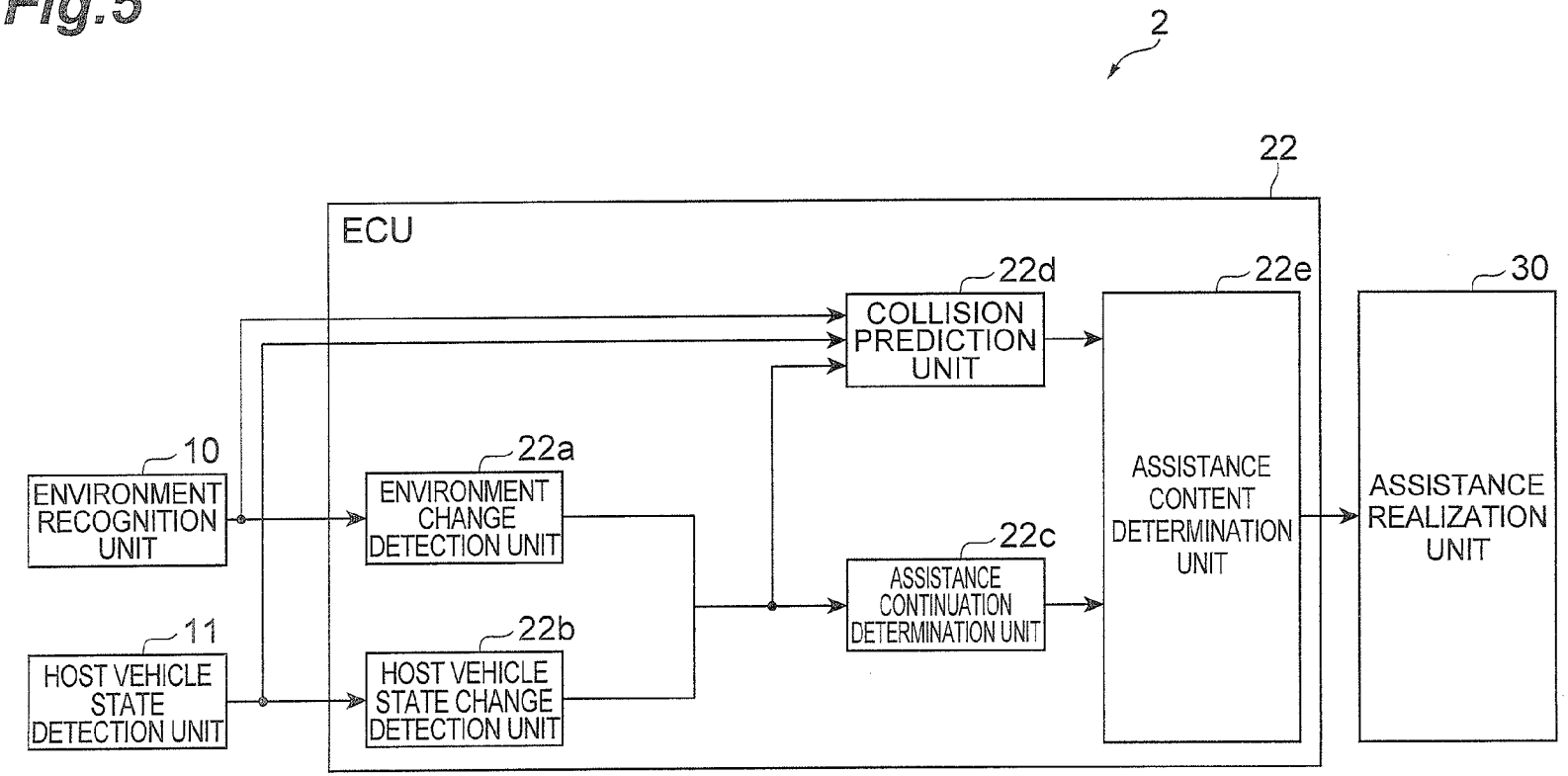
FIG. 5 is a configuration diagram of a driving assistance device in a second embodiment.
Figure 6:
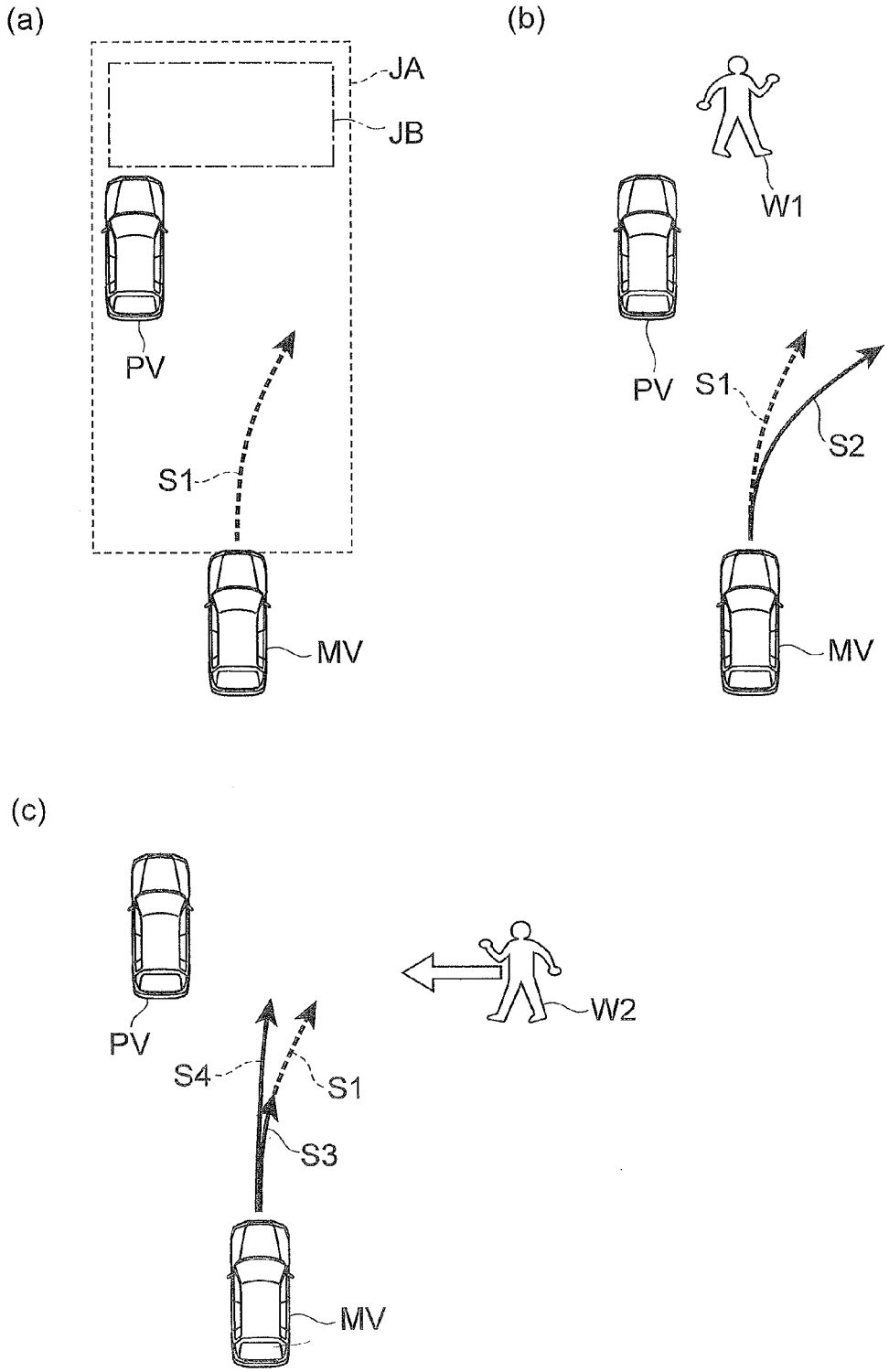
FIG. 6 is an example of assistance continuation determinations and changes of an assistance content; (*a*) illustrates an environment change determination range and an assistance content currently implemented, (*b*) illustrates a change of an assistance content in a case where an obstacle appears from the environment change determination range, and (*c*) illustrates a change of an assistance content in a case where an obstacle appears from outside the environment change determination range.
Figure 7:
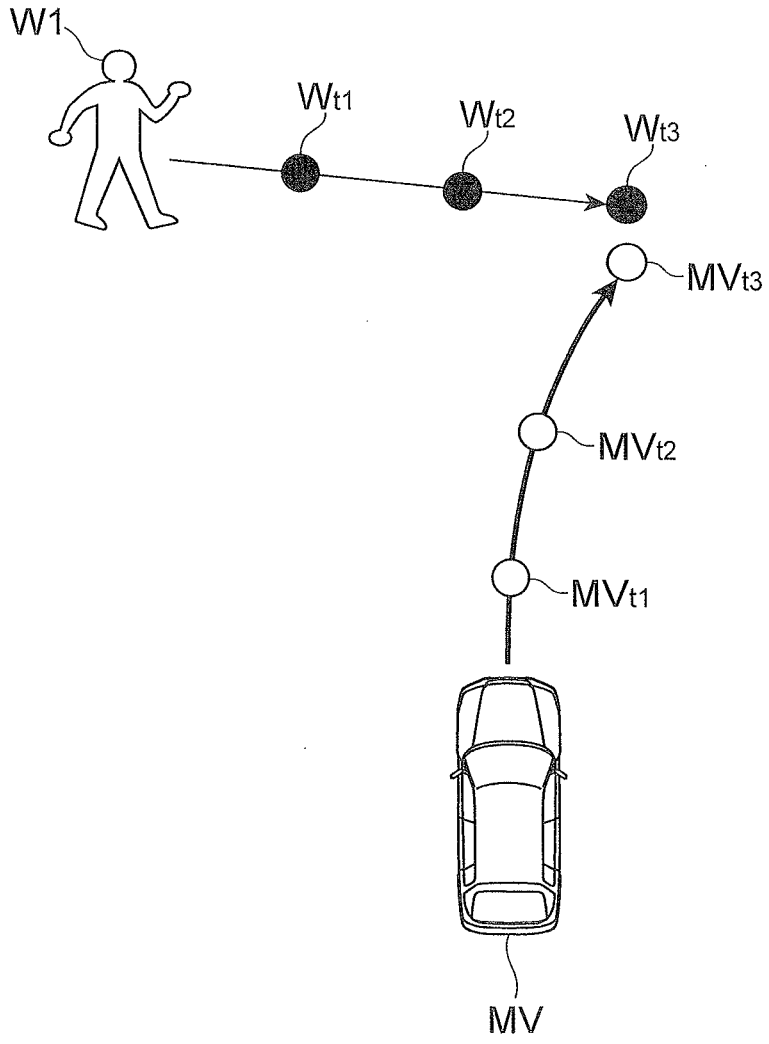
FIG. 7 is an explanatory diagram illustrating a brief prediction calculation in a case where the assistance content is changed.

A driving assistance device 2 in the second embodiment will be described with reference to FIG. 5 to FIG. 7. FIG. 5 is a configuration diagram of the driving assistance device 2 in the second embodiment. FIG. 6 is an example of assistance continue determinations and changes of an assistance content; (*a*) illustrates an environment change determination range and an assistance content which is currently implemented, (*b*) illustrates a change of an assistance content in a case where an obstacle appears from the environment change determination range, and (*c*) illustrates a change of an assistance content in a case where an obstacle appears from other than the environment change determination range. FIG. 7 is an explanatory diagram illustrating a brief prediction calculation in a case where the assistance content is changed.

The driving assistance device 2 can at least implement the prediction assistance for avoiding the collision between the host vehicle and the obstacle. In particular, the driving assistance device 2 determines whether the there is a change in the environment around the host vehicle or there is a change in the host vehicle state. In a case where there is the change, the driving assistance device 2 determines whether or not the safety in the current prediction assistance can be ensured, and in a case where the safety can be ensured, then continues to implement the current assistance content, and in a case where the safety cannot be ensured, then changes the assistance content to ensure the higher safety based on the currently implemented assistance content.

The driving assistance device 2 includes an environment recognition unit 10, a host vehicle state detection unit 11, an Electronic Control Unit (ECU) 22 (an environment change detection unit 22*a*, a host vehicle state change detection unit 22*b*, an assistance continuation determination unit 22*c*, a collision prediction unit 22*d*, and an assistance content determination unit 22*e*), and an assistance realization unit 30. The environment recognition unit 10, the host vehicle state detection unit 11, and the assistance realization unit 30 are similar means to the means described in the first embodiment, and the description thereof will not be repeated.

An ECU 22 is an electronic control unit which is formed of a CPU, a ROM, and a RAM, and integrally controls the driving assistance device 2. In the ECU 22, by an application program for the driving assistance device 2 (only for the prediction assistance) stored in the ROM being loaded on the RAM and being executed in the CPU, an environment change detection unit 22*a*, a host vehicle state change detection unit 22*b*, an assistance continuation determination unit 22*c*, a collision prediction unit 22*d*, and an assistance content determination unit 22*e* are configured.

In the predetermined determination range in front of the host vehicle (for example, the recognition range of the environment recognition unit 10), the environment change detection unit 22*a* compares (takes a difference in information between the present and the past) the obstacle information of the obstacle recognizable by the environment recognition unit 10 at present and the obstacle information of the obstacle recognizable by the environment recognition unit 10 in the past (only the previous information or the past information may be included), and detects whether there is a new change in movement of the obstacle or whether there appears a new obstacle. In addition, in the predetermined determination range in front of the host vehicle, the environment change detection unit 22*a* compares the recognized information about the traffic signs recognizable by the environment recognition unit 10 at present and the recognized information about the traffic signs recognizable by the environment recognition unit 10 in the past, and detects the whether a new factor is generated or not which increases the possibility that the obstacle will jump out to the driveway. A crosswalk is an example of such a factor.

The host vehicle state change detection unit 22*b* compares the host vehicle state currently detected by the host vehicle state detection unit 11 and the host vehicle state detected in the past by the host vehicle state detection unit 11 (takes a difference of host vehicle state in the past and current), and detects whether there is a new change in the host vehicle state. Here, by changes in the brake pedal operation, the accelerator pedal operation, the shifting operation, the steering operation, the vehicle speed, the acceleration, and the driver's line of sight, the host vehicle state change detection unit 22*b* detects whether or not there is a change of behavior by the host vehicle driver or a change of the traveling state by the road surface condition or the like.

In a case where the change in the environment around the host vehicle is detected by the environment change detection unit 22*a*, or in a case where the change in the host vehicle state is detected by the host vehicle state change detection unit 22*b*, the assistance continuation determination unit 22*c* determines whether the assistance content of the prediction assistance which is currently implemented will be continued or not, based on the state of the change in the environment around the host vehicle or the situation of the change in the host vehicle state.

An example of the determination method will be described with reference to FIG. 6. In this example, as illustrated in FIG. 6(*a*), since a parked vehicle PV (an obstacle) exists in the front left side of the host vehicle MV, a brake control for avoiding the parked vehicle PV is performed and a steering control to the right is performed as the prediction assistance which is currently implemented. When this prediction assistance is performed, the predicted travel route of the host vehicle MV is as indicated by a reference numeral S1. In addition, the environment change detection unit 22*a* performs the detection of the change in the environment in the determination range JA in front of the host vehicle MV or in the determination range JB which is farther from the parked vehicle PV that forms a blind spot, as illustrated in FIG. 6(*a*). An example in FIG. 6(*b*) illustrates a case where a walker W1 (an obstacle) jumps out from the position (the blind spot) where danger is assumed, the environment change detection unit 22*a* detects that a new walker W1 appears. In addition, an example in FIG. 6(*c*) illustrates a case where a walker W2 (an obstacle) jumps out from the position where danger is not assumed, the environment change detection unit 22*a* detects that a new walker W2 appears.

In case of the example illustrated in FIG. 6(*b*), the assistance continuation determination unit 22*c* determines that the entering direction of the walker W1 is from the left side of the driveway, and selects the assistance having a better effect (or the assistance that may rather make danger) among the braking assistance and the steering assistance which are currently implemented, in order to avoid in advance the collision with the walker W1 jumped out to the driveway from the left. In this case, the assistance continuation determination unit 22*c* selects the steering assistance to the right direction and determines whether the increasing of the steering amount of the steering control which is currently implemented is safer or not (the collision with the walker W1 can be avoided or not). In a case where it is determined that the increasing of the steering amount to the right direction is safer, the assistance continuation determination unit 22*c* determines to change the assistance content of the prediction assistance currently implemented, and in a case where it is determined that the safety can be ensured without changing the steering amount, determines to continue the assistance content of the prediction assistance currently implemented. In this case of FIG. 6(*b*), since the predicted travel route S2 moved further to the right direction than the predicted travel route S1 by the steering assistance currently implemented is safer, it is determined that the assistance content of the prediction assistance currently implemented be changed.

In case of the example illustrated in FIG. 6(*c*), the assistance continuation determination unit 22*c* determines that that the entering direction of the walker W2 is from the right side of the driveway, and selects the assistance having a better effect among the braking assistance and the steering assistance which are currently implemented, in order to avoid the collision in advance with the walker W2 jumped out to the driveway from the right. In this case, the assistance continuation determination unit 22*c* selects the braking assistance and determines whether the increasing of the braking amount of the braking assistance which is currently implemented is safer or not (the collision with the walker W2 can be avoided or not). In a case where it is determined that the increasing of the braking amount is safer, the assistance continuation determination unit 22*c* determines to change the assistance content of the prediction assistance currently implemented, and in a case where it is determined that the safety can be ensured without changing the braking amount, determines to continue the assistance content of the prediction assistance currently implemented. In this case of FIG. 6(*c*), since the predicted travel route S3 moved forward less than the predicted travel route S1 by the braking assistance currently implemented is safer, it is determined that the assistance content of the prediction assistance currently implemented be changed. Alternately, the assistance continuation determination unit 22*c* selects the steering assistance to the right direction and determines whether the decreasing of the steering amount of the steering assistance (including the case of the steering amount be zero) which is currently implemented is safer or not (the collision with the walker W2 can be avoided or not). In a case where it is determined that the decreasing of the steering amount to the right direction is safer, the assistance continuation determination unit 22*c* determines to change the assistance content of the prediction assistance currently implemented, and in a case where it is determined that the safety can be ensured without changing the steering amount, determines to continue the assistance content of the prediction assistance currently implemented. In this case of FIG. 6(*c*), since the predicted travel route S4 moved further straight forward than the predicted travel route S1 by the steering assistance currently implemented is safer, it is determined that the assistance content of the prediction assistance currently implemented be changed. In case of this example, it may be determined that the assistance content of both of the braking assistance and the steering assistance be changed.

Another example of the determination method will be described with reference to FIG. 7. In case of the example illustrated in FIG. 6, the determination is made by the direction from where the obstacle jumps out, but in this case, the determination is made by the speed of the obstacle jumping out. In this example also, as the prediction assistance currently implemented, the braking assistance and the steering assistance to the right direction is performed in order to avoid the parked vehicle PV in advance, as similar to the example in FIG. 6. In addition, the example in FIG. 7 is a case where the walker W1 (the obstacle) jumps out to the driveway from the left side, the environment change detection unit 22*a* detects the appearance of this new walker W1.

The assistance continuation determination unit 22*c* understands a movement state of the walker W1 based on the position, speed, and the like regarding the walker W1 recognized by the environment recognition unit 10, and understands the state of the host vehicle MV based on the position, speed, and the like detected by the host vehicle state detection unit 11. The assistance continuation determination unit 22*c* predicts the movement position $W_{t1}$, $W_{t2}$, $W_{t3}$, . . . on each time in point (t1, t2, t3, . . . ) in the future based on the movement state of the walker W1, and the traveling position $MV_{t1}$, $MV_{t2}$, $MV_{t3}$, . . . on each time in point (t1, t2, t3, . . . ) in the future based on the state of the host vehicle MV. The prediction here is not the prediction in consideration of all the possibility by the collision prediction unit 22*d*, but the prediction under the limited prediction focused on the situation with high possibility based on the current position, speed, forwarding direction, and the like, thus, the cost for calculation is low and the time for calculation also is short. Then, the assistance continuation determination unit 22*c* extracts the time point when the walker W1 and the host vehicle MV will become nearest, and calculates the distance d between the walker W1 and the host vehicle MV at the extracted time point. In this example, the walker W1 and the host vehicle MV approach near most at t3, and the distance $d_{t3}$ between the position $W_{t3}$ of the walker W1 at t3 and the position $MV_{t3}$ of the host vehicle MV at t3 is calculated. Furthermore, the assistance continuation determination unit 22*c* determines whether or not the near most distance $d_{t3}$ is larger than the threshold value $\epsilon$. This threshold value $\epsilon$ is set by an experiment or a simulation, and is a distance in which the safety can sufficiently be ensured even though the assistance is not performed. In a case where the near most distance d is equal to or smaller than the threshold value $\epsilon$, the assistance continuation determination unit 22*c* determines to change the assistance content of the prediction assistance currently implemented, and in a case where the near most distance d is larger than the threshold value $\epsilon$, determines to continue the assistance content of the prediction assistance currently implemented.

In a case where the environment change around the host vehicle is not detected by the environment change detection unit 22*a* and in a case where the change in the host vehicle state is not detected by the host vehicle state change detection unit 22*b*, collision prediction unit 22*d* performs the similar processing as the collision prediction unit 21*b* does in the first embodiment.

In a case where the processing in the collision prediction unit 22*d* is performed, the assistance content determination unit 22*e* performs the similar processing as the determination of the assistance content of the prediction assistance in the assistance content determination unit 21*c* in the first embodiment.

In addition, in a case where the assistance continuation determination unit 22*c* determines that the assistance content of the prediction assistance currently implemented be changed, the assistance content determination unit 22*e* determines the amount of control increased or decreased from the amount of the vehicle control under the prediction assistance currently implemented based on the determination content by the assistance continuation determination unit 22*c*, and transmits the changed assistance content to the assistance realization unit 30.

An example of the method of changing the assistance content with reference to FIG. 6. In case of the example illustrated in FIG. 6(*b*), since the assistance continuation determination unit 22*c* determines that increasing the amount of steering to the right direction of the steering control currently implemented is safer, the assistance content determination unit 22*e* calculates the amount of steering increased from the amount of steering to the right direction currently implemented, within the range where the host vehicle can safely turn. In addition, in the example illustrated in FIG. 6(*c*), since the assistance continuation determination unit 22*c* determines that increasing the amount of braking of the braking control currently implemented is safer, the assistance content determination unit 22*e* calculates the amount of braking increased from the amount of braking currently implemented, within the range where the host vehicle can safely be braked. Alternately, since the assistance continuation determination unit 22*c* determines that decreasing the amount of steering to the right direction of the steering control currently implemented is safer, the assistance content determination unit 22*e* calculates the amount of steering decreased from the amount of steering to the right direction currently implemented, within the range where the host vehicle can safely turn.

Another example of method for changing the assistance content will be described with reference to FIG. 7. Based on the amount of braking of the braking control or the steering amount of the steering control to the right direction currently implemented, the assistance content determination unit 22*e* calculates the amount of braking and the amount of steering to the right direction in such a manner that the distance d between the walker W1 and the host vehicle MV at the time point when the both approach near most determined by the assistance continuation determination unit 22*c* is larger than the threshold value ϵ. In the case of this example, by increasing the amount of braking of the braking control or the amount of steering of the steering control to the right direction, the distance d becomes farther, and the distance d between the host vehicle MV and the walker W after a predetermined time becomes larger than the threshold value ϵ. Of course, the amount of braking and the amount of steering to the right direction is calculated in such a manner that the distance d is larger than the threshold value ϵ even at each time point before the near most approaching time point. For example, the amount of braking of the braking control or the amount of steering of the steering control can be calculated by determining that, after how many seconds (near most time point) and at how fast vehicle speed the host vehicle MV passes a certain position where the distance d between the both is larger than the threshold value ϵ.

In addition, in a case where the assistance continuation determination unit 22*c* determines to continue the assistance content of the prediction assistance currently implemented, the assistance content determination unit 22*e* transmits the previous assistance content of the prediction assistance to the assistance realization unit 30.

In a case where the assistance content of the prediction assistance currently implemented is changed, the change of the amount of vehicle control is described. However, in a case where the assistance is performed by the other means such as HMI or the like, the assistance content of such means is changed. In addition, in a case where the obstacle does not exist at all, the prediction assistance is not performed, and a new obstacle is detected to appear, the processing by collision prediction unit 22*d* is required.

Figure 8:
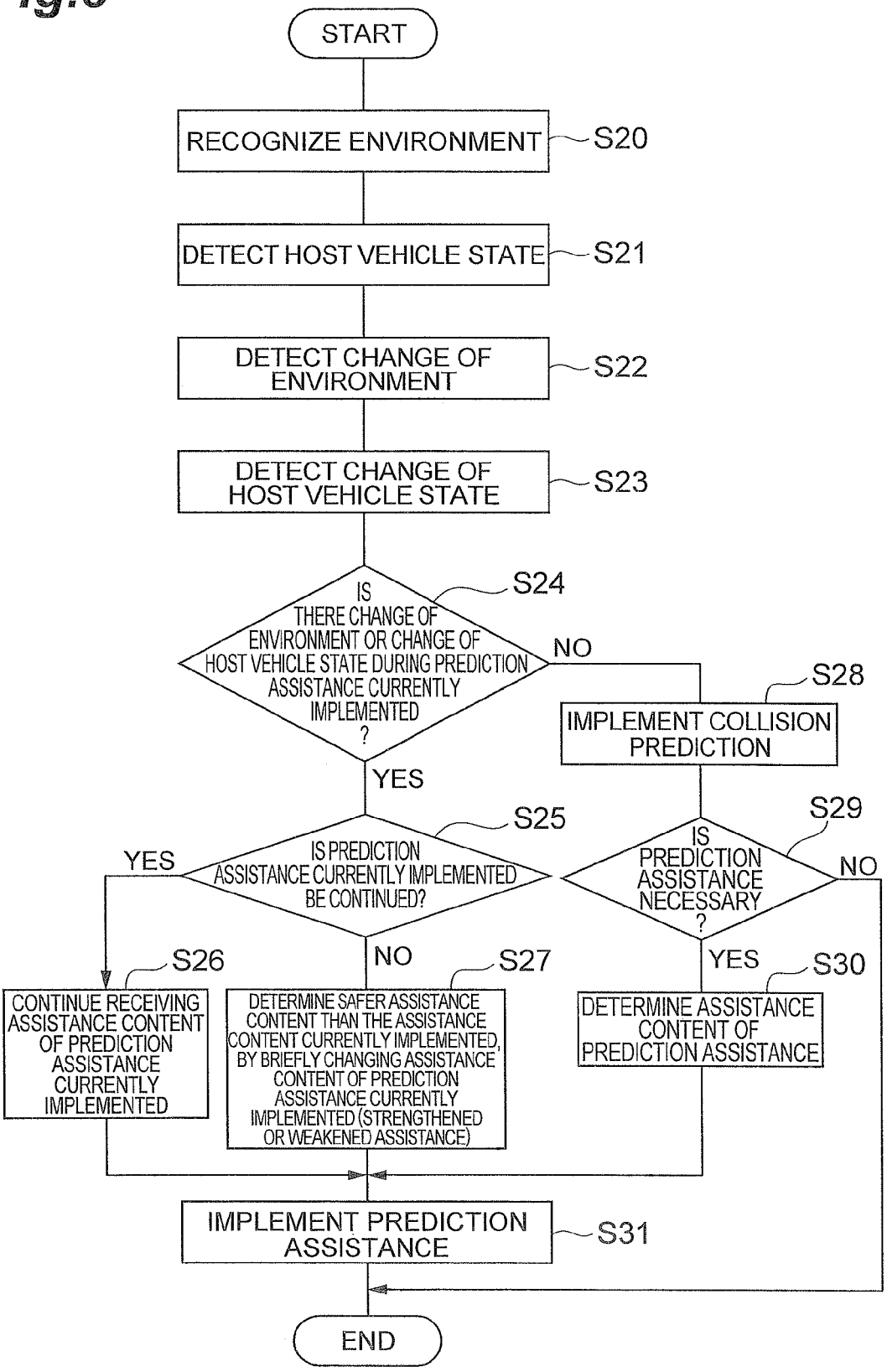
FIG. 8 is a flow chart illustrating an operation flow in the driving assistance device in the second embodiment.

With reference to FIG. 5, the operation in the driving assistance device 2 will be described along a flow chart in FIG. 8. FIG. 8 is the flow chart illustrating the operation flow in the driving assistance device in the second embodiment. In the driving assistance device 2, the operation described below is repeatedly performed for each predetermined time interval.

The environment recognition unit 10 recognizes the environment around the host vehicle, and transmits the recognized information to the ECU 22 (S20). In addition, the host vehicle state detection unit 11 detects the host vehicle state and transmits the detected information to the ECU 22 (S21).

The ECU 22 compares the recognized information of the present and past environment, and detects the change of the environment (S22). In addition, the ECU 22 compares the detected information about the current and past host vehicle state and detects the change of the host vehicle state (S23). Then, the ECU 22 determines whether or not there has been a change of environment or a change of host vehicle state between the assistance contents of the prediction assistance currently implemented (S24).

In a case where it is determined in S24 that there is a change of environment or a change of host vehicle state, the ECU 22 determines whether it is safe even if the assistance content of the prediction assistance currently implemented will be continued or it is safe if the such assistance will be changed (S25). In a case where it is determined in S25 that it is safe even if the assistance content of the prediction assistance currently implemented will be continued, the ECU 22 continues to receive the assistance content of the prediction assistance currently implemented and transmits the assistance content to the assistance realization unit 30 (S26). The assistance realization unit 30 continues to implement the prediction assistance currently implemented (S31). In addition, in a case where it is determined in S25 that it is safe if the assistance content of the prediction assistance currently implemented be changed, the ECU22 determines the safer assistance content than the assistance content currently implemented, by briefly changing the assistance content of the prediction assistance currently implemented, and transmits such assistance content to the assistance realization unit 30 (S27). The assistance realization unit 30 implements the assistance which is more strengthened or weakened than the assistance currently implemented (S31).

In a case where it is determined in S24 that there is not a change of environment nor a change of host vehicle state, the ECU 22 implements a collision prediction based on the recognition information about the environment around the host vehicle and the detection information about the host vehicle state (S28), and determines whether the prediction assistance is necessary or not (S29). In a case where it is determined in S29 that the prediction assistance is necessary, the ECU 22 determines the assistance content of the of the prediction assistance for avoiding the future collision in advance, and transmits such assistance content of the prediction assistance to the assistance realization unit 30 (S30). The assistance realization unit 30 implements the new assistance based on such the assistance content of the prediction assistance (S31). In addition, in a case where it is determined in S29 that the prediction assistance is not necessary, the ECU 22 does not perform the assistance, and ends the current processing.

Figure 9:
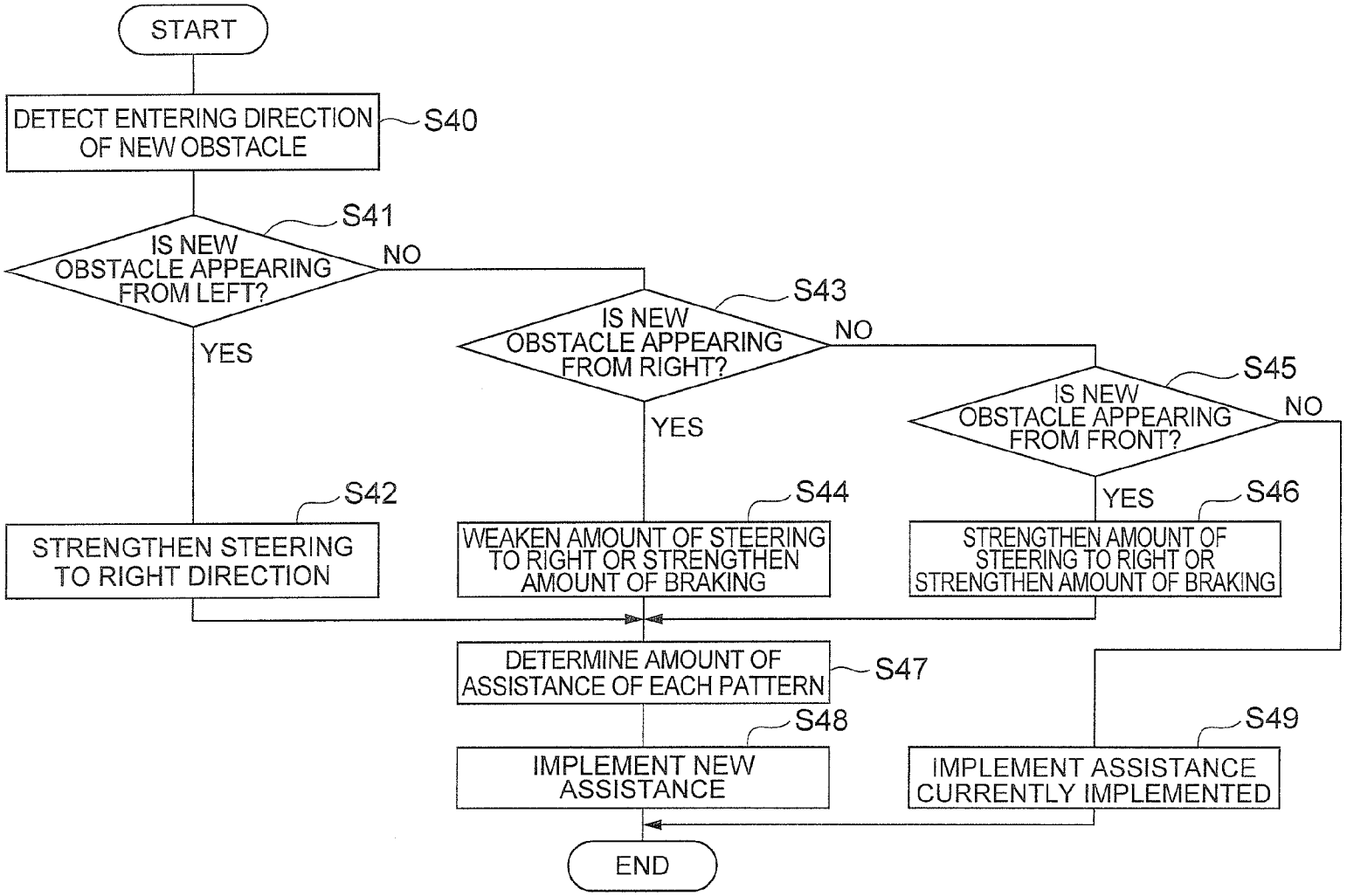
FIG. 9 is a flow chart illustrating an example of an operation flow in case of coping with a new obstacle in the driving assistance device in the second embodiment.

With reference to FIG. 5, the example of the operation in the driving assistance device 2 in case of coping with the new obstacle in FIG. 6 will be described in detail along a flow chart in FIG. 9. FIG. 9 is a flow chart illustrating an example of an operation flow in case of coping with a new obstacle in the driving assistance device 2 in the second embodiment. In case of this example, as the prediction assistance currently implemented, the braking control for avoiding the vehicle parked on the left front of the host vehicle and the steering control to the right direction are performed.

In a case where it is determined in S24 described above that there is a change of environment, the ECU 22 detects the entering direction of the new obstacle to the driveway (S40). The ECU 22 detects whether a new obstacle is appearing from the left or not (S41). In a case where it is determined in S41 that the new obstacle is appearing from the left, the ECU 22 determines that strengthening the steering assistance to the right direction currently implemented is safer (S42). Then, the ECU 22 determines the amount of steering increased from the amount of steering control to the right direction currently implemented, and transmits such the assistance content to the assistance realization unit 30 (S47). The assistance realization unit 30 implements the steering assistance more strengthened than the steering assistance to the right direction currently implemented based on the assistance content of the prediction assistance (S48).

In a case where it is determined in S41 that the new obstacle is not appearing from the left, the ECU 22 determines whether or not a new obstacle is appearing from the right (S43). In a case where it is determined in S43 that a the new obstacle is appearing from the right, the ECU 22 determines whether weakening the steering assistance to the right direction currently implemented is safer or strengthening the braking assistance currently implemented is safer (S44). Then, the ECU 22 determines the amount of steering decreased from the amount of steering of the steering control to the right direction currently implemented or the amount of braking increased from the amount of braking of the braking control currently implemented, and transmits such the assistance content to the assistance realization unit 30 (S47). The assistance realization unit 30 implements the steering assistance more weakened than the steering assistance to the right direction currently implemented based on the assistance content of the prediction assistance, or implements the braking assistance more strengthened than the braking assistance currently implemented (S48).

In a case where it is determined in S43 that the new obstacle is not appearing from the right, the ECU 22 determines whether or not a new obstacle is appearing from the front (S45). In a case where it is determined that the new obstacle is appearing from the front in S45, the ECU 22 determines whether strengthening the steering assistance to the right direction currently implemented is safer or strengthening the braking assistance currently implemented is safer (S46). Then, the ECU 22 determines the amount of steering increased from the amount of steering of the steering assistance to the right direction currently implemented or the amount of braking increased from the amount of braking of the braking assistance currently implemented, and transmits such the assistance content to the assistance realization unit 30 (S47). The assistance realization unit 30 implements the steering assistance more strengthened than the steering assistance to the right direction currently implemented based on the assistance content of the prediction assistance, or implements the braking assistance more strengthened than the braking assistance currently implemented (S48).

In a case where it is determined in S45 that the new obstacle is not appearing from the front, the ECU 22 determines to continue the assistance content of the prediction assistance currently implemented (it is possible to sufficiently ensure the safety by the current assistance), and transmits the assistance content of the prediction assistance currently implemented to the assistance realization unit 30. The assistance realization unit 30 continues to implement the assistance currently implemented (S49).

According to the driving assistance device 2, even in a case where the prediction assistance is implemented, the change of the environment around the host vehicle and the change of the host vehicle state are detected, and in a case where there is the change, by determining whether continuing the prediction assistance currently implemented is safer or changing the assistance content of the prediction assistance currently implemented is safer, it is possible to immediately ensure the safety with reducing the calculation cost without repeating to perform the calculation of the collision prediction of which the calculation cost is high. As a result, it is possible to immediately change the assistance in response to the new threat also. In addition, by using the time earned by the brief calculation like this (the time to approach the obstacle is delayed), it is possible to perform the calculation of the collision prediction in consideration of all the situation and to update the detailed assistance content of the prediction assistance.

According to the driving assistance device 2, in a case where the continuing of the prediction assistance is determined or the assistance content of the prediction assistance currently implemented is changed, since each calculation is performed using the brief information such as the appearing direction of the new obstacle and the distance between the host vehicle and the obstacle at the time when both approach near most, it is possible to significantly reduce the calculation cost and to promptly cope with the situation.

Figure 10:
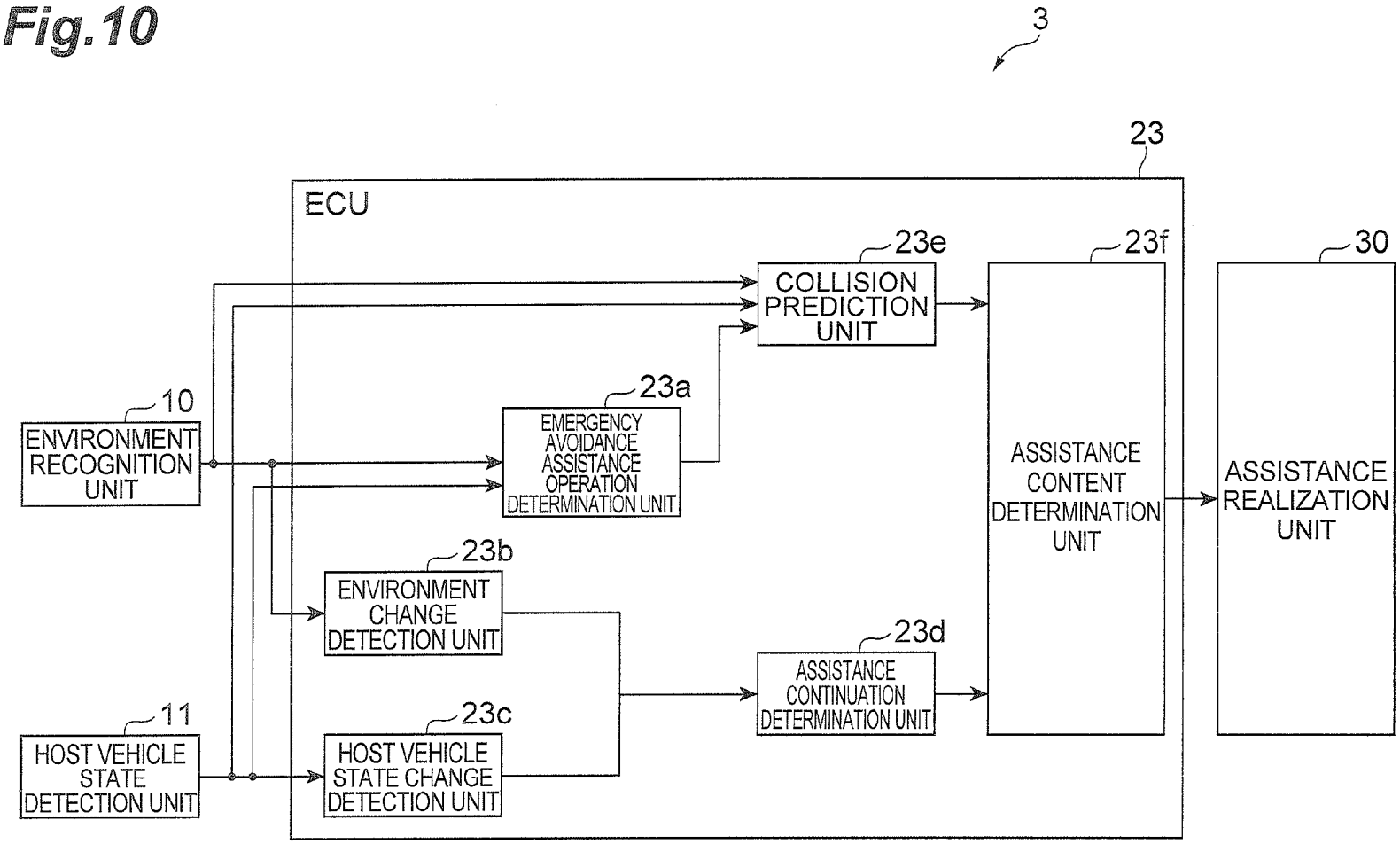
FIG. 10 is a configuration diagram of a driving assistance device in a third embodiment.

With reference to FIG. 10, the driving assistance device 3 in the third embodiment will be described. FIG. 10 is the configuration diagram of the driving assistance device in the third embodiment.

The driving assistance device 3 can implement the emergency avoidance assistance and the prediction assistance in order to avoid the collision between the host vehicle and the obstacle, and implements any of the emergency avoidance assistance and the prediction assistance selected. In particular, the driving assistance device 3 determines the emergency of the collision, and in a case where there is an emergency, immediately implements the emergency avoidance assistance, and in a case where there is not an emergency, implements the prediction assistance. Furthermore, the driving assistance device 3, in a case where the prediction assistance is implemented, determines whether there is the change of environment around the host vehicle or the change of the host vehicle state. In a case where it is determined that there is the change, the driving assistance device 3 determines whether or not it is possible to ensure the safety with the prediction assistance currently implemented, and in a case where it is possible to ensure the safety, continues the assistance content currently implemented, and in a case where it is not possible to ensure the safety, changes the assistance content to the assistance content having more safety based on the assistance content of the prediction assistance currently implemented.

The driving assistance device 3 includes the environment recognition unit 10, the host vehicle state detection unit 11, an Electronic Control Unit (ECU) 23 (an emergency avoidance assistance operation determination unit 23*a*, an environment change detection unit 23*b*, a host vehicle state change detection unit 23*c*, an assistance continuation determination unit 23*d*, a collision prediction unit 23*e*, and an assistance content determination unit 23*f*), and an assistance realization unit 30. The environment recognition unit 10, the host vehicle state detection unit 11, and the assistance realization unit 30 are the similar means to the means described in the first embodiment, and the description will not be repeated.

In the third embodiment, the emergency avoidance assistance operation determination unit 23*a* is corresponding to the necessity determination means described in the Claims, the environment change detection unit 23*b* is corresponding to environment change detection means described in the Claims, the host vehicle state change detection unit 23*c* is corresponding to host vehicle state change detection means described in the Claims, the assistance continuation determination unit 23*d* is corresponding to continuation determination means described in the Claims, and the assistance content determination unit 23*f* and the assistance realization unit 30 are corresponding to implementation means described in the Claims.

An ECU 23 is an electronic control unit which is formed of a CPU, a ROM, and a RAM, and integrally controls the driving assistance device 3. In the ECU 23, by an application program for the driving assistance device 3 stored in the ROM being loaded on the RAM and being executed in the CPU, an emergency avoidance assistance operation determination unit 23*a*, an environment change detection unit 23*b*, a host vehicle state change detection unit 23*c*, an assistance continuation determination unit 23*d*, collision prediction unit 23*e*, and an assistance content determination unit 23*f* are configured. The emergency avoidance assistance operation determination unit 23*a* and the collision prediction unit 23*e* are the similar means to the means described in the first embodiment, and the description will not be repeated. In addition, the environment change detection unit 23*b*, the host vehicle state change detection unit 23*c*, and the assistance continuation determination unit 23*d* are the similar means to the means described in the second embodiment, and the description will not be repeated. In addition, the assistance content determination unit 23*f* is means in which the assistance content determination unit described in the first embodiment and the assistance content determination unit described in the second embodiment are integrated, and the description will not be repeated.

Figure 11:
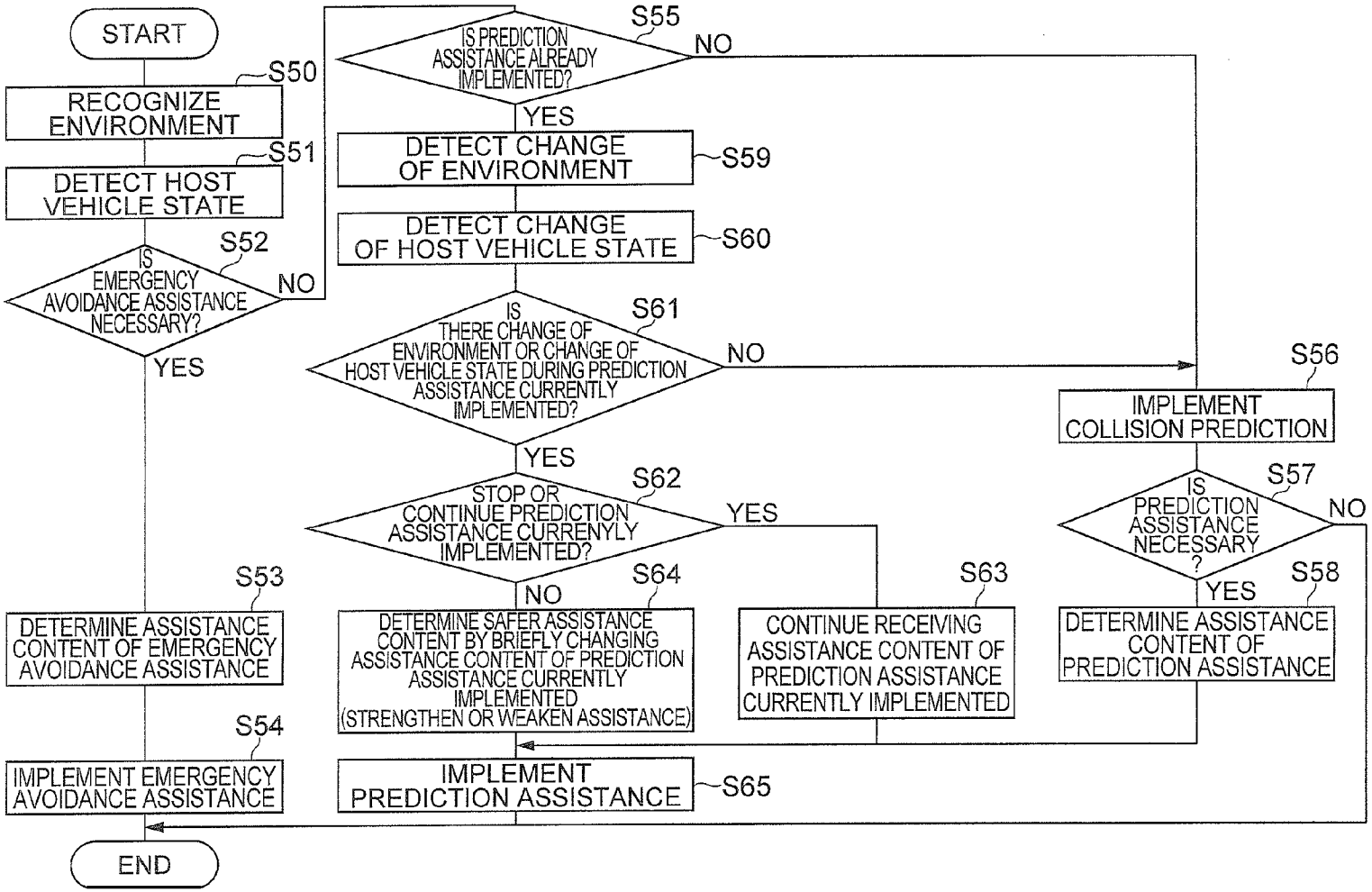
FIG. 11 is a flow chart illustrating an operation flow in the driving assistance device in the third embodiment.

With reference to FIG. 10, the operation in the driving assistance device 3 will be described along a flow chart in FIG. 11. FIG. 11 is the flow chart illustrating the operation flow in the driving assistance device in the third embodiment. In the driving assistance device 3, the operation described below is repeatedly performed for each predetermined time interval.

The environment recognition unit 10 recognizes the environment around the host vehicle, and transmits the recognized information to the ECU 23 (S50). In addition, the host vehicle state detection unit 11 detects the host vehicle state and transmits the detected information to the ECU 23 (S51). Then, the ECU 23 determines whether or not the emergency avoidance assistance is necessary based on the recognized information about the environment around the host vehicle and the detected information about the host vehicle state (S52).

In a case where it is determined in S52 that the emergency avoidance assistance is necessary, the ECU 23 determines the assistance content of the emergency avoidance assistance for avoiding the collision in the emergency state, and transmits the assistance content to the assistance realization unit 30 (S53). The assistance realization unit 30 implements the emergency avoidance assistance based on the assistance content of the emergency avoidance assistance (S54).

In a case where it is determined in S52 that the emergency avoidance assistance is not necessary, the ECU 23 determines whether or not the prediction assistance is already implemented (S55). In a case where it is determined in S55 that the prediction assistance is not implemented yet, the ECU 23 implements the collision prediction based on the recognized information about the environment around the host vehicle and detected information about the host vehicle state (S56), and determines whether or not the prediction assistance is necessary (S57). In a case where it is determined in S57 that the prediction assistance is necessary, the ECU 23 determines the assistance content of the prediction assistance for avoiding the future collision in advance, and transmits the assistance content to the assistance realization unit 30 (S58). The assistance realization unit 30 implements the prediction assistance based on the assistance content of the prediction assistance (S65). In addition, in a case where it is determined in S57 that the prediction assistance is not necessary, the ECU 23 ends the current process without performing the assistance.

In a case where it is determined in S55 that the prediction assistance is already implemented, the ECU 23 detects the change of environment by comparing the recognized information about the current and past environments (S59), and detects the change of the host vehicle state by comparing the detected information about the current and past host vehicle states (S60). Then, the ECU 23 determines whether or not the environment is changed, or whether or not the host vehicle state is changed during the prediction assistance currently implemented (S61).

In a case where it is determined in S61 that the environment is changed or the host vehicle state is changed, the ECU 23 determines whether it is safe even if the assistance content of the prediction assistance currently implemented will be continued or it is safe if the such assistance be changed (S62). In a case where it is determined in S62 that it is safe even if the assistance content of the prediction assistance currently implemented will be continued, the ECU 23 continues to receive the assistance content of the prediction assistance currently implemented and transmits the assistance content to the assistance realization unit 30 (S63). The assistance realization unit 30 continues to implement the prediction assistance currently implemented (S65). In addition, in a case where it is determined in S62 that it is safe if the assistance content of the prediction assistance currently implemented be changed, the ECU 23 determines the safer assistance content by briefly changing the assistance content of the prediction assistance currently implemented, and transmits the assistance content to the assistance realization unit 30 (S64). The assistance realization unit 30 implements the prediction assistance which is more strengthened or weakened than the assistance content currently implemented (S65).

In a case where it is determined in S61 that neither the environment nor the host vehicle state is changed, the ECU 23 implements the collision prediction (S56), and determines whether or not the prediction assistance is necessary (S57). In a case where it is determined in S57 that the prediction assistance is necessary, the ECU 23 determines the assistance content of the prediction assistance, and transmits the assistance content to the assistance realization unit 30 (S58). The assistance realization unit 30 implements new prediction assistance based on the assistance content of the prediction assistance (S65). In addition, in a case where it is determined in S57 that the prediction assistance is not necessary, the ECU 23 ends the current process without performing the assistance.

The driving assistance device 3 has both of the effects, which are the effect of the driving assistance device 1 described in the first embodiment and the driving assistance device 2 described in the second embodiment.

Hereinbefore, the embodiments in the present invention are described. However, the present invention is not limited to the embodiments described above, and a variety of forms may be embodied.

For example, in the embodiments, the present invention is applied to the driving assistance device that performs the driving assistance by the vehicle control and the HMI or the like. However, the present invention may be applied to the other device such as a control device that performs automatic driving.

In addition, in the embodiments, an example of the method of the emergency avoidance assistance (PCS) and the prediction assistance (including the collision prediction) is illustrated. However, the emergency avoidance assistance and the prediction assistance may be performed by another method.

In addition, in the second embodiment, an example of the case where the appearance of a new obstacle is detected is described. However, even in a case where a change of movement of an already detected obstacle is detected, in a case where a factor which causes movement of an obstacle to be changed is detected, or in a case where a change of the driver's behavior is detected from the changes of the braking operation, the steering operation, the shift operation, the vehicle speed, and the driver's line of sight of the host vehicle, similarly, the driving assistance device determines whether strengthening or weakening the assistance currently implemented is safer or continuing the assistance currently implemented is safer, and then, in a case where it is determined that changing the assistance is safer, simply changes the amount of assistance currently implemented.

In addition, in the second and third embodiment, the driving assistance device detects the change of the environment around the host vehicle and the change of the host vehicle state and determines whether the prediction assistance currently implemented will be continued or not. However, the driving assistance device may detect any of the change of the environment around the host vehicle or the change of the host vehicle state, and may determine whether the prediction assistance currently implemented will be continued or not.

INDUSTRIAL APPLICABILITY

A driving assistance device can implement emergency avoidance assistance which is performed for avoiding a collision between a host vehicle and an obstacle in a case where the current state is in a timing of the collision, and prediction assistance which is performed by predicting a possibility of a future collision. It is possible to perform the assistance according to emergency level of the collision by implementing any of the emergency avoidance assistance and the prediction assistance by the determination of the necessity of the emergency avoidance assistance. When it is the time of emergency state, it is possible to avoid (decrease) the collision without delaying the assistance, and when it is not the time of emergency state, it is possible to avoid the future collision in advance by the highly accurate prediction.

REFERENCE SIGNS LIST

1, 2, 3 driving assistance device
10 environment recognition unit
11 host vehicle state detection unit
21, 22, 23 ECU
21*a*, 23*a* emergency avoidance assistance operation determination unit
21*b*, 22*d*, 23*e* collision prediction unit
21*c*, 22*e*, 23*f* assistance content determination unit
22*a*, 23*b* environment change detection unit
22*b*, 23*c* host vehicle state change detection unit
22*c*, 23*d* assistance continuation determination unit
30 assistance realization unit

The invention claimed is:

1. A driving assistance device that can implement emergency avoidance assistance which is assistance for urgently avoiding a collision between a host vehicle and an obstacle and prediction assistance which is assistance for avoiding a future collision between a host vehicle and an obstacle in advance, and implements the assistance by selecting any of the emergency avoidance assistance and the prediction assistance, the driving assistance device comprising:

necessity determination means for determining whether or not the emergency avoidance assistance is necessary;

collision prediction means for predicting a future traveling range of the host vehicle and a future moving range of the obstacle, and predicting a possibility of the future collision based on the predicted traveling range and the moving range, and then determining whether or not the prediction assistance is necessary, in a case where the necessity determination means determines that the emergency avoidance assistance is not necessary; and implementation means for implementing the emergency avoidance assistance in a case where the necessity determination means determines that the emergency avoidance assistance is necessary, and implementing the prediction assistance in a case where the collision prediction means determines that the prediction assistance is necessary, wherein the necessity determination means determines the possibility of the collision between the host vehicle and the obstacle in a case where the current state of the host vehicle and the obstacle will be continued, and determines that the emergency avoidance assistance is necessary in a case where it is determined that there is a possibility of the collision.

2. The driving assistance device according to claim 1, further comprising:

environment change detection means for detecting a change of environment around the host vehicle; and continuation determination means for determining whether or not the prediction assistance currently implemented will be continued, based on the detection result of the environment change detection means, in a case where the prediction assistance is implemented.

3. The driving assistance device according to claim 2, further comprising:

host vehicle state change detection means for detecting the change of the host vehicle state, wherein, in a case where the prediction assistance is implemented, the continuation determination means determines whether or not the prediction assistance currently implemented will be continued, based on the detection result of the host vehicle state change detection means.

4. The driving assistance device according to claim 2, wherein, in a case where the continuation determination means determines that the prediction assistance will not be continued, the implementation means implements the more strengthened or weakened assistance than the assistance content currently implemented, based on the assistance content currently implemented.

5. A driving assistance device that can implement emergency avoidance assistance which is assistance for urgently avoiding a collision between a host vehicle and an obstacle and prediction assistance which is assistance for avoiding a future collision between a host vehicle and an obstacle in advance, and implements the assistance by selecting any of the emergency avoidance assistance and the prediction assistance, the driving assistance device comprising:

a necessity determination unit that determines whether or not the emergency avoidance assistance is necessary;

a collision prediction unit that predicts a future traveling range of the host vehicle and a future moving range of the obstacle, and predicting a possibility of the future collision based on the predicted traveling range and the moving range, and then determining whether or not the prediction assistance is necessary, in a case where the necessity determination unit determines that the emergency avoidance assistance is not necessary; and an implementation unit that implements the emergency avoidance assistance in a case where the necessity determination unit determines that the emergency avoidance assistance is necessary, and implementing the prediction assistance in a case where the collision prediction unit determines that the prediction assistance is necessary, wherein the necessity determination unit determines the possibility of the collision between the host vehicle and the obstacle in a case where the current state of the host vehicle and the obstacle will be continued, and determines that the emergency avoidance assistance is necessary in a case where it is determined that there is a possibility of the collision.

6. A driving assistance method conducted by a driving assistance device that can implement emergency avoidance assistance which is assistance for urgently avoiding a collision between a host vehicle and an obstacle and prediction assistance which is assistance for avoiding a future collision between a host vehicle and an obstacle in advance, and implements the assistance by selecting any of the emergency avoidance assistance and the prediction assistance, the driving assistance method comprising:

a necessity determination step of determining whether or not the emergency avoidance assistance is necessary by a processor;

a collision prediction step of predicting a future traveling range of the host vehicle and a future moving range of the obstacle, and predicting a possibility of the future collision based on the predicted traveling range and the moving range, and then determining whether or not the prediction assistance is necessary, in a case where the emergency avoidance assistance is determined not to be necessary in the necessity determination step by the processor; and an implementation step of implementing the emergency avoidance assistance in a case where the emergency avoidance assistance is determined to be necessary in the necessity determination step, and implementing the prediction assistance in a case where the prediction assistance is determined to be necessary in the collision prediction step by the processor, wherein, in the necessity determination step, the possibility of the collision between the host vehicle and the obstacle in a case where the current state of the host vehicle and the obstacle will be continued, is determined, and the emergency avoidance assistance is determined to be necessary in a case where it is determined that there is a possibility of the collision.

7. The driving assistance method according to claim 6, further comprising:

an environment change detection step of detecting a change of environment around the host vehicle; and a continuation determination step of determining whether or not the prediction assistance currently implemented will be continued based on the detection result in the environment change detection step in a case where the prediction assistance is implemented.

8. The driving assistance method according to claim 7, further comprising:

a host vehicle state change detection step of detecting the change of the host vehicle state, wherein, in the continuation determination step, in a case where the prediction assistance is implemented, whether or not the prediction assistance currently implemented will be continued is determined based on the detection result in the host vehicle state change detection step.

9. The driving assistance method according to claim 7, wherein, in the implementation step, in a case where it is determined that the prediction assistance will not be continued in the continuation determination step, the more strengthened or weakened assistance than the assistance content currently implemented is implemented based on the assistance content currently implemented.

* * * * *